US005598061A

United States Patent [19]

Nakamura et al.

[11] Patent Number: 5,598,061

[45] Date of Patent: Jan. 28, 1997

[54] PHOTOMULTIPLIER

[75] Inventors: Kimitsugu Nakamura; Yoshio Fujita; Keiichi Ohishi, all of Hamamatsu, Japan

[73] Assignee: Hamamatsu Photonics K.K., Hamamatsu, Japan

[21] Appl. No.: 399,989

[22] Filed: Mar. 7, 1995

[30] Foreign Application Priority Data

Mar. 7, 1994 [JP] Japan ..... 6-035790

[51] Int. Cl.[6] ..... H01J 43/04; H01J 43/20; H01J 43/00

[52] U.S. Cl. ..... 313/532; 313/533; 313/534; 313/105 R

[58] Field of Search ..... 313/532, 533, 313/534, 535, 536, 524, 103, 105 CM, 105 R

[56] References Cited

U.S. PATENT DOCUMENTS 4,575,657 3/1986 Kaiser ..... 313/536
5,416,382 5/1995 L'Hermite ..... 313/532

FOREIGN PATENT DOCUMENTS 0571201 11/1993 European Pat. Off. .

OTHER PUBLICATIONS

Patent abstracts of Japan, vol. 008, No. 226, Oct. 1984 and JP–A–59 108254 (Hamamatsu Hotonikusu KK) Jun. 22, 1984.

European Search Report dated Jul. 14, 1995.

*Primary Examiner*—Sandra L. O'Shea
*Assistant Examiner*—John Ning
*Attorney, Agent, or Firm*—Cushman Darby & Cushman IP Group of Pillsbury Madison & Sutro LLP

[57] ABSTRACT

A photomultiplier includes a photoelectric surface for photoelectrically converting incident light and emitting electrons, and a plurality of stages of dynodes for multiplying the electrons. The photomultiplier includes a first dynode array including box-and-grid dynodes arranged in a vessel and a second dynode array including in-line dynodes arranged in the vessel. A dynode having a curved secondary electron emitting layer opposes both a secondary electron emitting layer of a last stage dynode of the first dynode array and a secondary electron emitting layer of a first-stage dynode of the second dynode array.

6 Claims, 7 Drawing Sheets

PHOTOMULTIPLIER

BACKGROUND OF THE INVENTION

1. Field of the Invention

The present invention relates to a photomultiplier having a photoelectric surface for photoelectrically converting incident light and emitting electrons, and a plurality of stages of dynodes for multiplying the electrons.

2. Related Background Art

A photomultiplier has a photoelectric surface(photocathode) for converting incident light into electrons, dynodes for multiplying the electrons, and an anode for collecting the electrons, and is used to detect weak light. A conventional photomultiplier using box-and-grid dynodes and mesh-type dynodes is known in Japanese Patent Laid-Open No. 59-108254.

As a conventional photomultiplier using in-line dynodes is known. The in-line dynode is used as a head-on type photomultiplier. In such an in-line dynode, however, the distance between the photoelectric surface and the anode is long, resulting in a bulky photomultiplier. To solve this problem, a device constituted by combining a box-and-grid type photomultiplier and a mesh type photomultiplier is described in Japanese Patent Laid-Open No. 59-108254.

The photomultiplier with a flat structure is excellent because of its low dependency of time characteristics on an incident position and high operability in a high magnetic field. However, the response speed is lower than that of an in-line photomultiplier. Additionally, when the above mesh type dynode is used, electrons pass through the mesh ($\eta$=40%), and a gain per unit dynode becomes low. To obtain a sufficient gain, ten stages of dynodes are required.

SUMMARY OF THE INVENTION

The present invention has been made in consideration of the above problems, and has as its object to provide a photomultiplier having a short tube length, a high gain, and a high response speed.

In order to solve the above problems, the present inventors made various photomultipliers with different arrangements or shapes of dynodes. The present inventors made comparison and examinations of these various photomultipliers, and found that a compact photomultiplier having a high electron collection efficiency, a high gain, and a high response speed could be manufactured.

More specifically, the present invention is to provide a photomultiplier having a photocathode for photoelectrically converting incident light and emitting electrons, and an electron multiplication unit formed of a plurality of stages of dynodes each having a secondary electron emitting surface on an inner surface. The electron multiplication unit comprises a first half unit(first dynode array) consisting of box-and-grid dynodes including a first-stage dynode having a secondary electron emitting layer opposing the photocathode, a second half unit consisting of in-line dynodes, and a connecting dynode having a curved inner surface opposing both a secondary electron emitting layer of a last-stage dynode of the first half unit and the secondary electron emitting layer of a first-stage dynode of the second half unit.

More specifically, the first half unit of the photomultiplier is formed of the first- to third-stage box-and-grid dynodes, and the second half unit is formed by the plurality of stages of in-line dynodes, and an anode electrode. The connecting dynode is formed by the fourth-stage connecting dynode arranged between the third-stage box dynode and the in-line dynode.

More specifically, the first-stage box dynode has a first electron incident opening (first input opening edge) opposing the photocathode, a first electron exit opening (first output opening edge) substantially perpendicular to the first electron incident opening, and a first secondary electron emitting layer formed on a curved inner surface. The first-stage box electrode is arranged such that the electrons emitted from the photocathode pass through the first electron incident opening and are irradiated on the first secondary electron emitting layer, multiplied, and emitted from the first electron exit opening.

The second-stage box-and-grid dynode has a second electron incident opening opposing the first secondary electron emitting layer, a second electron exit opening substantially perpendicular to the second electron emitting incident opening, and a second secondary electron emitting layer formed on a curved inner surface of the second dynode. This dynode is arranged such that the electrons emitted from the first secondary electron emitting layer pass through the second electron incident opening and are irradiated on the second secondary electron emitting layer, multiplied by the second secondary electron emitting layer, and emitted from the second electron exit opening.

The third-stage box-and-grid dynode has a third electron incident opening opposing the second secondary electron emitting layer, a third electron exit opening substantially perpendicular to the third electron incident opening, and a third secondary electron emitting layer formed on a curved inner surface of the third dynode. This dynode is arranged such that the electrons emitted from the second secondary electron emitting layer pass through the third electron incident opening and are irradiated on the third secondary electron emitting layer, multiplied by the third secondary electron emitting layer, and emitted through the third electron exit opening.

The fourth-stage connecting dynode has an outer surface arranged to oppose an outer surface of the first-stage box-and-grid dynode, a fourth electron incident opening opposing the third secondary electron emitting layer, a fourth electron exit opening crossing the fourth electron incident opening at an acute angle, and a fourth secondary electron emitting layer formed on a curved inner surface of the fourth dynode. This dynode is arranged such that the electrons emitted from the third secondary electron emitting layer pass through the fourth electron incident opening and are irradiated on the fourth secondary electron emitting layer, multiplied by the fourth secondary electron emitting layer, and emitted through the fourth electron exit opening.

The plurality of stages of in-line dynodes are arranged to extend in a direction from the third secondary electron emitting layer to the third electron exit opening such that the electrons emitted from the fourth secondary electron emitting surface are irradiated and multiplied.

The anode electrode is arranged to collect the electrons multiplied by the in-line dynodes.

According to the photomultiplier of the present invention, electrons emitted from the photocathode are incident in the first half unit and multiplied. The electrons emitted from the first half unit are incident in the connecting dynode and emitted to the second half unit. Since the second half unit is formed of in-line dynodes, the photomultiplier can maintain high-speed characteristics. Additionally, since the first half unit is constituted by box-and-grid dynodes, high-gain characteristics can be ensured.

More specifically, light incident on the photocathode is photoelectrically converted into electrons. Electrons emitted from the photocathode are irradiated on the first secondary electron emitting layer of the first-stage box-and-grid dynode through the first electron incident opening arranged to oppose the photocathode. The irradiated electrons are multiplied by the first secondary electron emitting layer and emitted from the first electron exit opening.

The electrons emitted from the first secondary electron emitting layer are irradiated on the second secondary electron emitting layer of the second-stage box-and-grid dynode through the second electron incident opening opposing the first secondary electron emitting layer. The irradiated electrons are multiplied by the second secondary electron emitting surface and emitted through the second electron exit opening.

Thereafter, the electrons emitted from the second secondary electron emitting surface are irradiated on the third secondary electron emitting layer of the third-stage (odd-numbered stage) box dynode through the third electron incident opening opposing the second secondary electron emitting layer. The irradiated electrons are multiplied by the third secondary electron emitting layer and emitted through the third electron exit opening.

The electrons are irradiated on the fourth secondary electron emitting layer through the fourth electron incident opening of the fourth-stage connecting dynode having an outer surface arranged to oppose that of the first-stage box-and-grid dynode. The irradiated electrons are multiplied by the fourth secondary electron emitting layer and emitted through the fourth electron exit opening. The electrons are emitted from the fourth electron exit opening crossing the fourth electron incident opening at an acute angle, so that the electrons can be efficiently introduced into the plurality of stages of in-line dynodes which are arranged to extend in a direction from the third secondary electron emitting layer to the third electron exit opening. The introduced electrons are multiplied by the in-line dynodes and collected by the anode electrode.

The photocathode and the dynodes are arranged in a vacuum vessel. A higher potential is applied to a subsequent stage dynode through a lead pin extending through the vacuum vessel.

A detailed arrangement to efficiently collect the electrons from the third-stage box-and-grid dynode by the fourth-stage connecting dynode and efficiently emit the electrons to the in-line dynode unit at the subsequent stage is as follows. It is preferable for an end portion of the fourth electron incident opening on an outer surface side of the first-stage box dynode to be separated from a plane including the third electron incident opening in a direction to be separated from the outer surface of the first-stage box-and-grid dynode by a distance corresponding to 1/7 to 1/5 a maximum distance between the third electron incident opening of the third-stage box-and-grid dynode and a third electron multiplication surface opposing the third electron incident opening. To improve the above efficiency, this distance is most preferably 1/6 the maximum distance.

When the end portion of the fourth electron incident opening is separated by such a distance, a fourth electron multiplication surface of the fourth-stage connecting dynode preferably has a composite shape of part of a circumferential surface and a plane extending from the circumferential surface toward the third electron exit opening.

More specifically, the fourth-stage connecting dynode has a structure to easily receive the potential of the dynodes at the subsequent stage. In the photomultiplier, when at least one of the first to fourth electron incident openings has a net-like grid, or when a focusing electrode for focusing the electrons from the photoelectric surface into the first electron incident opening is arranged between the first electron incident opening and the photoelectric surface, the gain of the photomultiplier can be increased, and the detection sensitivity can be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 1:
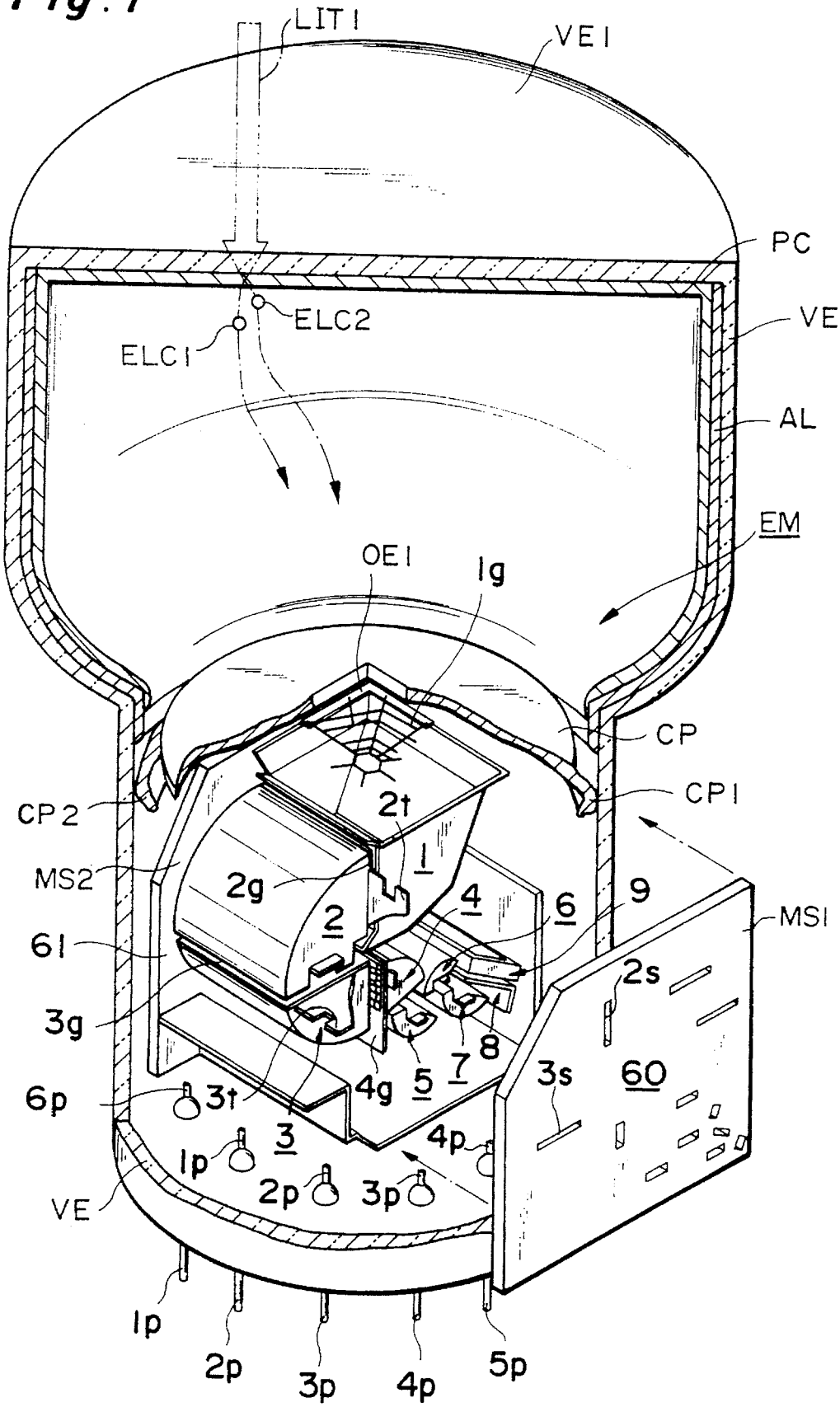
FIG. 1 is a partially cutaway view of a photomultiplier shown in FIG. 7, in which a side wall 600 is removed.

A photomultiplier according to an embodiment of the present invention will be described below with reference to the accompanying drawings. The same reference numerals denote the same elements throughout the drawings.

Figure 7:
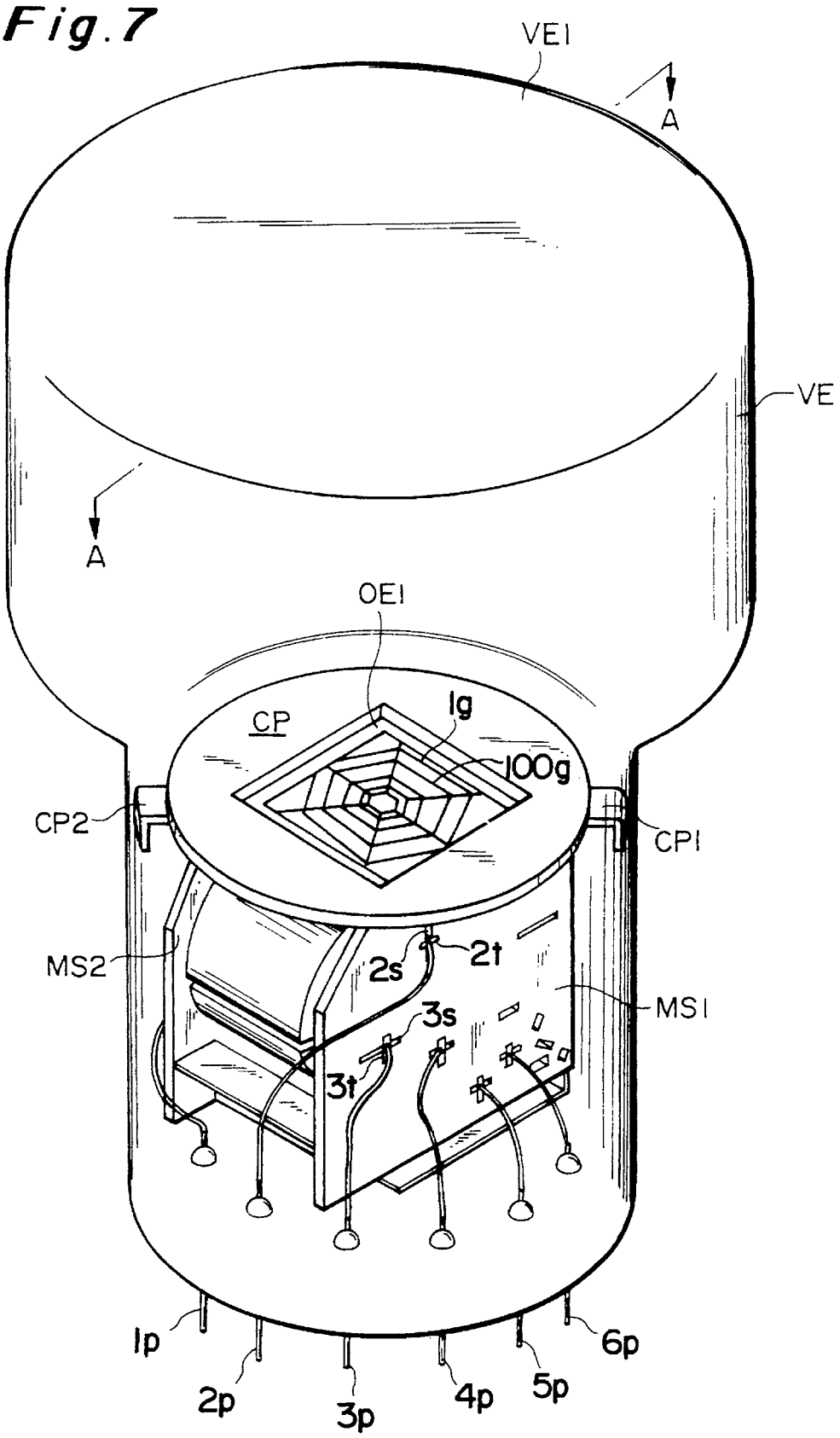
FIG. 7 is a view showing the outer appearance of the photomultiplier.

FIG. 7 is a view showing the outer appearance of a photomultiplier. An aluminum film AL and a photoelectric film PC shown in FIG. 1, are not shown in FIG. 7.

Figure 2:
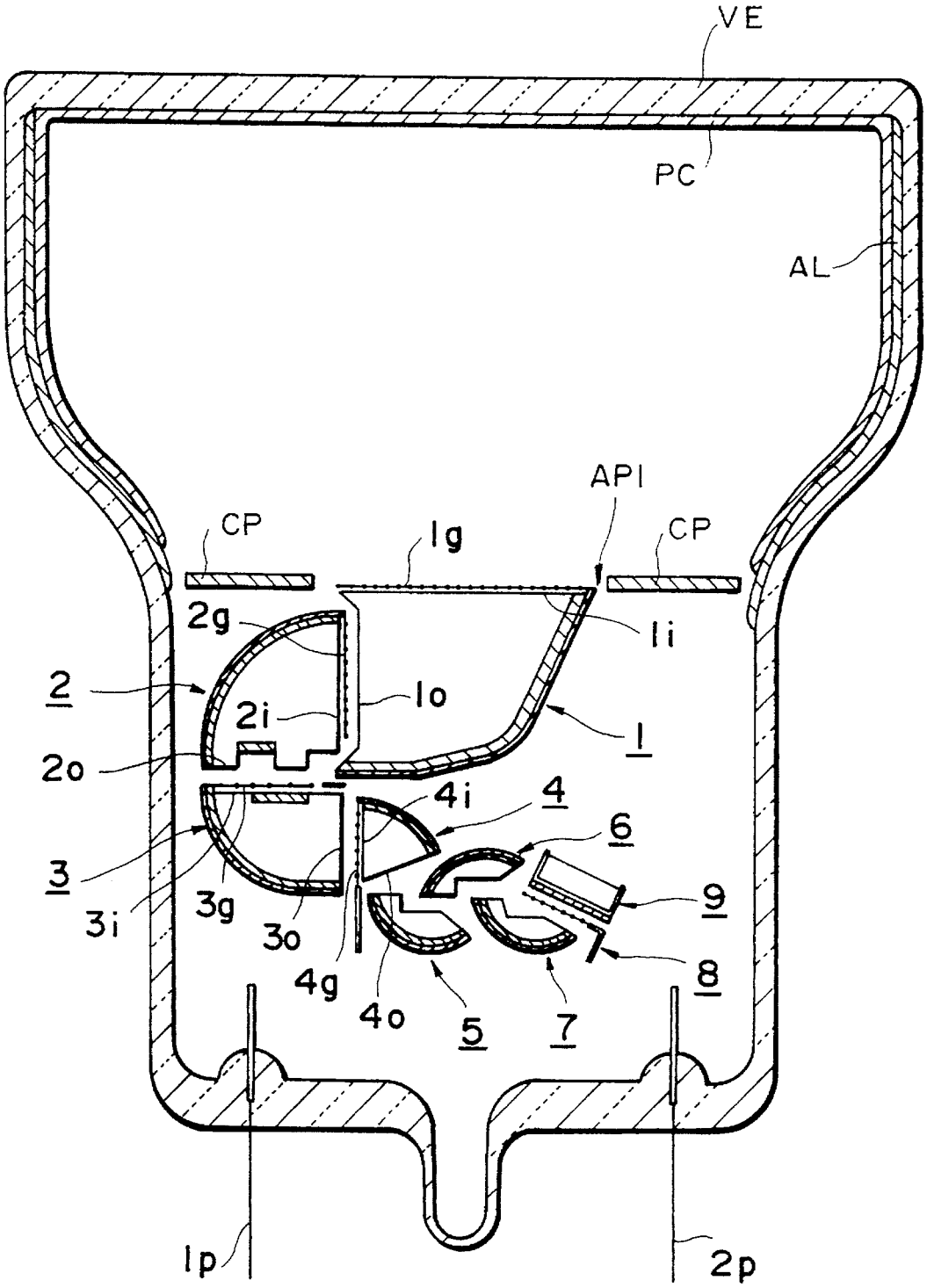
FIG. 2 is a longitudinal sectional view of the photomultiplier shown in FIG. 7 along an arrow A—A.
Figure 3:
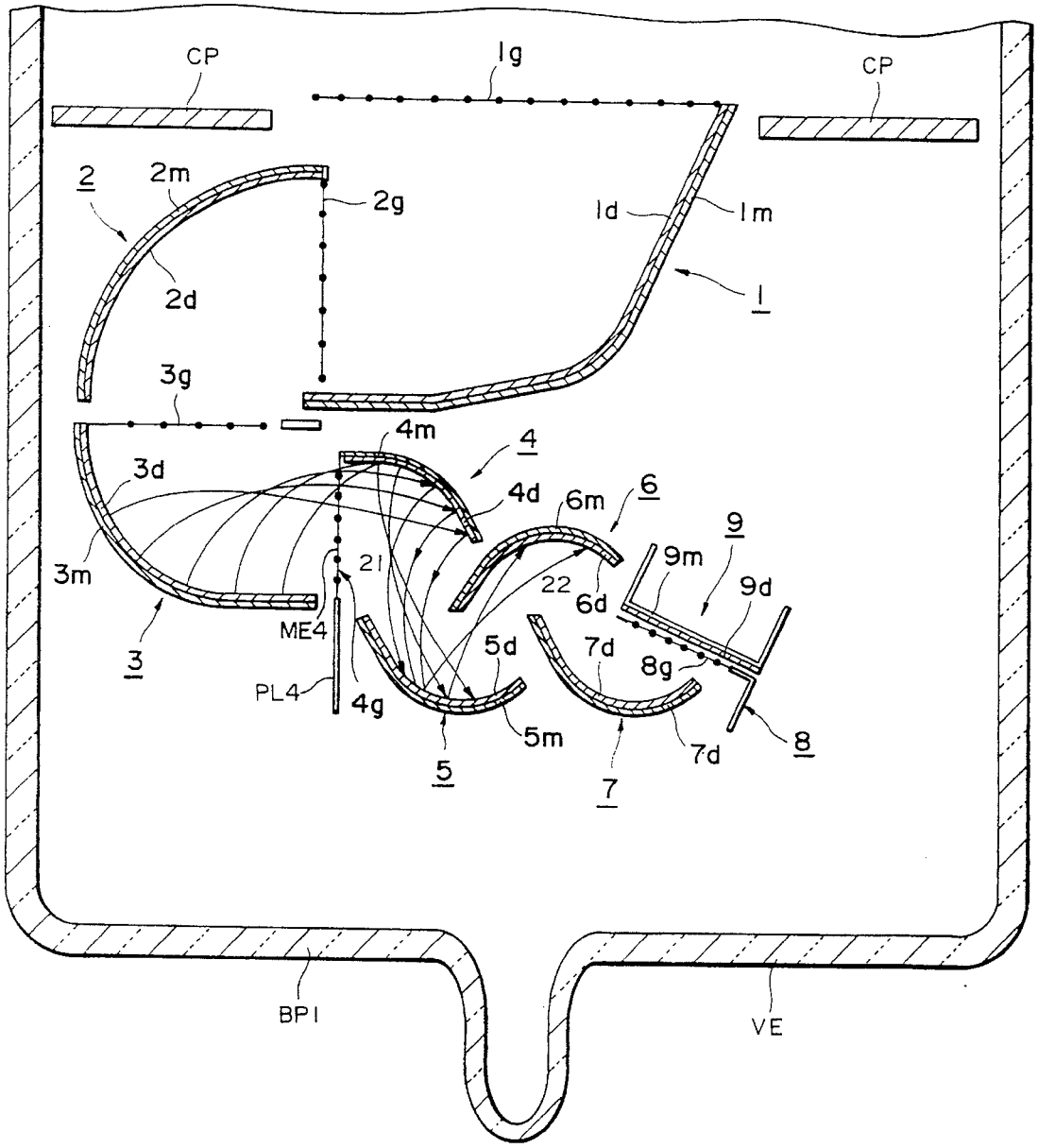
FIG. 3 is an enlarged sectional view for explaining the shapes and arrangement of the dynodes of the photomultiplier shown in FIG. 2.
Figure 4:
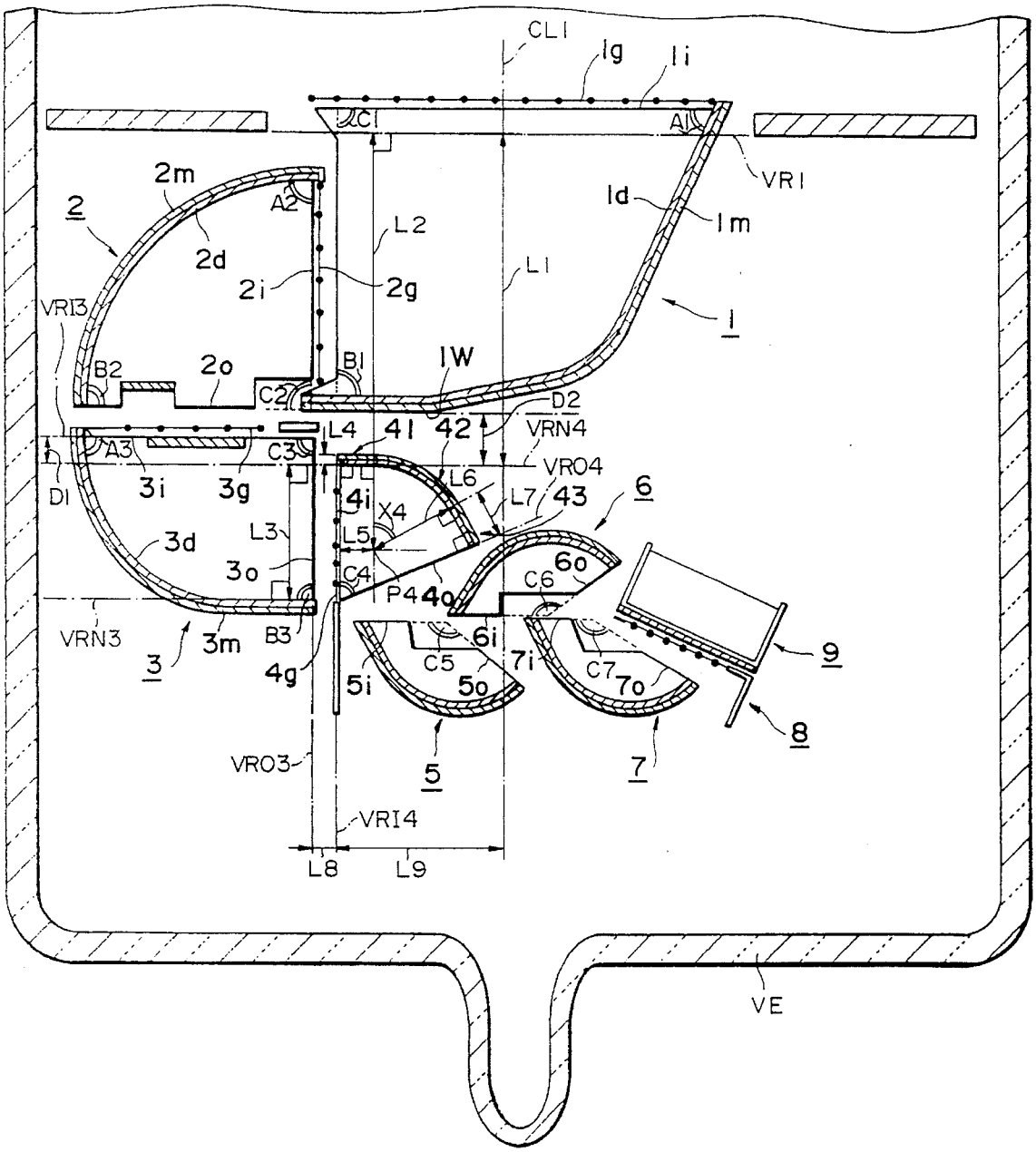
FIG. 4 is a sectional view showing the arrangement of the dynodes shown in FIG. 3 in more detail.

FIG. 1 is a partially cutaway view of the photomultiplier shown in FIG. 7, in which a side wall 60 is removed. FIG. 2 to 4 are longitudinal sectional views of the photomultiplier shown in FIG. 7 along the line A—A.

The photomultiplier has a vacuum vessel VE made of glass, a photoemissive cathode (photocathode) PC fixed to a faceplate VE1 of the vessel VE an Al film (Al coating) AL fixed to an inner surface of the vessel VE, a circular focusing electrode CP having a rectangular opening AP1 at its central portion, pins 1*p* to 6*p* penetrating the vessel VE, and an electron multiplication unit EM arranged in the vessel VE.

The vacuum vessel VE is made of a transparent material such as glass, and the pressure inside the vacuum vessel VE is in a range from $10^{-7}$ to $10^{-10}$ Torr.

The photocathode PC is fixed to the inner surface of the vessel VE made of glass. The semitransparent photocathode PC is made of photocathode material such as alkali-antimonides. Light input into the photomultiplier through the faceplate VE1 is converted into photoelectrons in the photocathode PC.

The Al coating AL is an internal conductive coating AL which coats the inner surface of the vessel VE. The Al coating AL surrounds the circular focusing electrode CP. The photoelectrons generated in the photocathode PC are focused by the internal conductive coating AL and the circular electrode CP, and the photoelectrons are introduced into a first dynode 1 through a first input aperture defined by an input opening edge 1*i* of the first dynode 1.

The focusing electrode CP is arranged between the electron multiplication unit EM and the photocathode PC.

The electron multiplication unit EM has a first half unit(first dynode array) consisting of box-and-grid dynodes 1, 2 and 3, a connecting dynode 4, a second half unit(second dynode array) consisting of in-line dynodes 5, 6 and 7, an anode 8, an ultimate dynode 9, and side walls 60 and 61 sandwiching the dynodes 1 to 7 and 9 and anode 8. The second dynode array consisting of the in-line dynodes 5, 6 and 7 is arranged at the stage subsequent to the fourth-stage connecting dynode 4. The anode electrode 8 is arranged between the last-stage or ultimate dynode 9 and the seventh dynode 7.

The circular focusing electrode CP has leg portions CP1 and CP2 projecting from the outer circumferential surface of the focusing electrode CP. The circular focusing electrode CP is arranged in the vacuum vessel VE and held by the leg portions CP1 and CP2. The leg CP1 and the Al film AL coating the inner surface of the vacuum vessel VE are in contact with each other. The leg CP2 and the inner surface of the vacuum vessel VE are in contact with each other.

The pin 1*p* penetrates the vessel VE and is electrically connected to the first box-and-grid dynode 1. The pin 2*p* penetrates the vessel VE and is electrically connected to the second box-and-grid dynode 2. The pin 3*p* penetrates the vessel VE and is electrically connected to the third box-and-grid dynode 3. The pin 4*p* penetrates the vessel VE and is electrically connected to the fourth connecting dynode 4. The pin 5*p* penetrates the vessel VE and is electrically connected to the fifth in-line dynode 5. The pin 6*p* penetrates the vessel VE and is electrically connected to the sixth in-line dynode 6. Other pins (not shown) penetrate the vessel VE and are respectively connected to the seventh dynode 7, anode 8, and ultimate dynode 9.

The side walls(insulating support plates) 60 and 61 have a plurality of fixing through holes. The side walls 60 and 61 are in a mirror symmetrical relationship. The side wall 60 will be described below.

The side wall 60 has the holes 2*s* and 3*s*. The second dynode 2 has a T-shaped portion 2*t*. The T-shaped portion 2*t* penetrates the hole 2*s*. The T-shaped portion 2*t* is inserted into the fixing hole 2*s* and twisted, thereby the second dynode 2 is fixed to the side wall 60. The T-shaped fixing plate 2*t* is connected to the second dynode 2. The T-shaped fixing plate 2*t* extending from the second-stage dynode 2 is connected to the lead pin 2*p*.

The third dynode 3 has a T-shaped portion 3*t*. The T-shaped portion 3*t* penetrates the hole 3*s*. The T-shaped portion 3*t* is inserted into the fixing hole 3*s* and twisted, thereby the third dynode 3 is fixed to the side wall 60. The T-shaped fixing plate 3*t* is connected to the third dynode 3. The T-shaped fixing plate 3*t* extending from the third-stage dynode 3 is connected to the lead pin 3*p*. The second and third dynodes 2 and 3 are fixed to the side walls 60 and 61.

Like the second and third dynodes 2 and 3, the remaining dynodes 1, 4 to 7, and 9, and anode 8, are also fixed to the side walls 60 and 61, and connected to the lead pins. Predetermined potentials are applied to the lead pins, thereby the potentials are applied to the dynodes 1 to 7 and 9, and anode 8.

FIG. 2 to 4 show sectional views. FIG. 4 is a longitudinal sectional view of the photomultiplier shown in FIG. 7 along an arrow A—A. A plane defined by the arrow A—A includes a center line CL1 of the tube VE, and the plane is parallel to a main surface MS1 of side wall 60. The first main surface MS1 is parallel to a second main surface MS2 of the second side wall 61. The dynodes 1 to 7 and 9, and anode 8 are arranged between the main surfaces MS1 and MS2.

FIG. 2, FIG. 3, and FIG. 4 are sectional views showing the arrangement of the dynodes and the anode shown in FIG. 1.

The first-stage box-and-grid dynode 1 has a first box-shaped metal plate 1*m*, a first secondary emitter(secondary electron emitting layer) 1*d* formed on an inner surface of the curved metal plate 1*m*, and a first accelerating grid 1*g* fixed to the metal plate 1*m*.

The first secondary emitter 1*d* is made of secondary-emission material such as alkali antimony(for example $Cs_3Sb$), beryllium oxide(BeO:Cs), magnesium oxide(MgO:Cs), gallium phosphide, gallium arsenide phosphide, or Ag-O-Cs.

The first box-and-grid dynode 1 has the first input opening edge 1*i*, and a first output opening edge 1*o*. The first input opening edge 1*i* faces the photocathode (photoelectric surface) PC. The first input aperture of the first dynode 1 is defined by the opening edge 1*i*, and a first output aperture of the first dynode 1 is defined by the output opening edge 1*o*. The first accelerating grid 1*g* covers the first input aperture defined by the opening edge 1*i*. The first accelerating grid 1*g* is fixed to the first input opening edge 1*i*. The first grid is a spider-web-like acceleration grid. The grid 1*g* has a square plate OE1 having an opening, and a spider-web-like wire 100*g* fixed to the plate OE1. The plate OE1 defines a opening edge of the aperture of the first grid 1*g*.

An angle A1 between the first input opening edge 1*i* and a surface of the secondary emitter layer 1*d* near the input opening edge 1*i* is 66°. The angle A1 is greater than 50° and smaller than 70°. An angle B1 between the first output opening edge 1*o* and the surface of the secondary emitter 1*d* near the first output opening edge 1*o* is 19°. The angle B1 is greater than 0° and smaller than 53°. An angle C1 between the first input opening edge 1*i* and the first output opening edge 1*o* is 55°. The first input opening aperture defined by the opening edge 1*i* is substantially perpendicular to the first output aperture defined by the output opening edge 1*o*. The angle C1 is greater than 0° and smaller than 60°. The first input opening edge 1*i* and the first accelerating grid 1*g* are substantially parallel to each other.

The photoelectric surface(photocathode) PC is arranged to oppose the first electron incident opening defined by the opening edge 1*i* of the first-stage dynode 1. The photocathode PC is made of photocathode material such as alkali-antimonides.

The first-stage dynode 1 is arranged such that the electrons emitted from the photoelectric surface PC pass through the first electron incident opening 1*i* and are irradiated on the first secondary electron emitting surface 1*d*, multiplied, and emitted from the first electron exit opening 1*o*.

The second-stage box-and-grid dynode 2 has a second box-shaped metal plate 2*m*, a second secondary emitter (secondary electron emitting layer) 2d formed on an inner surface of the curved metal plate 2m, and a second accelerating grid 2g fixed to the curved metal plate 2m.

The second secondary emitter 2d is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The second box-and-grid dynode 2 has a second input opening edge 2i, and a second output opening edge 2o. The second input opening edge 2i faces the first output opening edge 1o. A second input aperture of the second dynode 2 is defined by the opening edge 2i, and a second output aperture of the second dynode 2 is defined by the output opening edge 2o. The second accelerating grid 2g covers the second input aperture defined by the opening edge 2i. The second accelerating grid 2g is fixed to the second input opening edge 2g. The second accelerating grid 2g is arranged between the first output opening edge 1o and the second input opening edge 2i.

An angle A2 between the second input opening edge 2i and a surface of the second secondary emitter layer 2d near the input opening edge 2i is 90°. The angle A2 is greater than 80° and smaller than 100°. An angle B2 between the second output opening edge 2o and the surface of the second secondary emitter 2d near the second output opening edge 2o is 90°. The angle B2 is greater than 80° and smaller than 100°. An angle C2 between the second input opening edge 2i and the second output opening edge 2o is 90°. The angle C2 is greater than 80° and smaller than 100°. The second input opening edge 2i and the second accelerating grid 2g are substantially parallel to each other. The second input opening edge 2i and the first output opening edge 1o are substantially parallel to each other.

The second-stage box dynode 2 is arranged such that the electrons emitted from the first secondary electron emitting surface 1d pass through the second electron incident opening 2i and are irradiated on the second secondary electron emitting surface 2d, multiplied, and emitted from the second electron exit opening 2o.

The third-stage box-and-grid dynode 3 has a third box-shaped metal plate 3m, a third secondary emitter (secondary electron emitting layer) 3d formed on an inner surface of the curved metal plate 3m, and a third accelerating grid 3g fixed to the metal plate 3m.

The third secondary emitter 3d is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The third box-and-grid dynode 3 has a third input opening edge 3i, and a third output opening edge 3o. The third input opening edge 3i faces the second output opening edge 2o. A third input aperture of the third dynode 3 is defined by the opening edge 3i, and a third output aperture of the third dynode 3 is defined by the output opening edge 3o. The third honeycomb accelerating grid 3g covers the second input aperture defined by the opening edge 3i. The third accelerating grid 3g is fixed to the third input opening edge 3i. The third accelerating grid 3g is arranged between the second output opening edge 2o and the third input opening edge 3i.

An angle A3 between the third input opening edge 3i and a surface of the second secondary emitter layer 3d near the input opening edge 3i is 90°. The angle A3 is greater than 80° and smaller than 100°. An angle B3 between the third output opening edge 3o and the surface of the third secondary emitter 3d near the third output opening edge 3o is 90°. The angle B3 is greater than 80° and smaller than 100°. A maximum angle C3 between the third input opening edge 3i and the third output opening edge 3o is 90°. The angle C3 is greater than 80° and smaller than 100°. The third input opening edge 3i and the third accelerating grid 3g are substantially parallel to each other. The third input opening edge 3i and the second output opening edge 2o are parallel to each other.

The third-stage box dynode 3 is arranged such that the electrons emitted from the second secondary electron emitting surface 2d pass through the third electron incident opening 3i and are irradiated on the third secondary electron emitting surface 3d, multiplied, and emitted from the third electron exit opening 3o.

The fourth-stage connecting dynode 4 has a fourth metal plate 4m which is curved, a fourth secondary emitter(secondary electron emitting layer) 4d formed on an inner surface of the curved metal plate 4m, and a fourth accelerating grid 4g fixed to the metal plate 4m.

The fourth-stage connecting dynode 4 is arranged such that an outer surface of the fourth dynode 4 opposes an outer surface of the first-stage box-and-grid dynode 1.

The fourth secondary emitter 4d is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The fourth connecting dynode 4 has a fourth input opening edge 4i, and a fourth output opening edge 4o. The fourth input opening edge 4i faces the third output opening edge 3o. A fourth input aperture of the fourth dynode 4 is defined by the opening edge 4i, and a fourth output aperture of the fourth dynode 4 is defined by the output opening edge 4o.

The fourth accelerating grid 4g covers the fourth input aperture defined by the opening edge 4i. The fourth accelerating grid 4g is fixed to the fourth input opening edge 4i. The fourth accelerating grid 4g is arranged between the third output opening edge 3o and the fourth input opening edge 4i.

The fourth grid 4g has a shielding-plate portion PL4 and a mesh portion ME4 fixed to the shielding-plate portion PL4. The mesh portion ME4 covers the fourth input aperture 4i. The shielding-plate portion PL4 extends from the mesh portion ME4 toward a bottom plate BP of the vessel VE, and the shielding-plate portion PL4 is arranged between the fifth dynode 5 and the third dynode 3 as shown in FIG. 3. The grids 2g to 4g are net-like(honeycomb) acceleration grids.

The fourth secondary emitter layer 4d has a composite shape. The fourth secondary emitter layer 4d has a first linear portion 41, a curved portion 42 extending from the first linear portion 41, and a second linear portion 43 extending from the curved portion 42 (see FIG. 4). The inner surface of the fourth secondary emitter layer 4d is formed by surfaces of the potions 41 to 43. The inner surface of the fourth secondary emitter layer 4d is a circumferential surface which includes a circumferential surface of 60° of the curved portion 42, a plane of the linear portion 43 extending from the curved portion 42 toward the fourth output opening edge 4o, and the plane of the linear portion 41 extending from the circumferential surface 42 toward the third output opening edge 3o.

A fourth virtual inner plane VRN4 including an exposed surface of the first linear portion 41 of the secondary emitter layer 4d is arranged between a third virtual input plane VRI3 including the third input opening edge 3i, and a third virtual inner plane VRN3 including the inner surface of the third secondary emitter layer 3*d* near the third output opening edge 3*o*. The third virtual inner plane VRN3 is substantially parallel to the third virtual input plane VRI3. In other words, the fourth virtual inner plane VRO4 near the fourth opening edge 4*i* crosses the inner surface of the third secondary emitter layer 3*d*.

A distance D1 between the fourth virtual inner plane VRN4 and the third virtual input plane VRI3 is preferably 1.38 mm. The distance D1 is greater than 0.5 mm and smaller than 1.5 mm. The fourth virtual inner plane VRN4 is substantially parallel to the first virtual plane VR1 defined by a lower surface of the circular focusing electrode plate CP. The first virtual plane VR1 is substantially parallel to the first input opening edge 1*i*.

The minimum distance D2 between the inner surface (fourth virtual inner plane VRN4) 4*d* of the fourth dynode 4 and the outer surface 1*w* of first dynode 1 is greater than the minimum distance D1 between the third input opening edge 3*i* and the fourth virtual inner plane VRN4 including the inner surface 4*d* of the fourth dynode 4.

The distance D1 is a distance corresponding to 1/7 to 1/5 the maximum distance between the third input opening edge 3*i* of the third dynode 3 and the third secondary electron emitting surface 3*d* opposing the third input opening edge 3*i*.

The minimum distance D1 between the third input opening edge 3*i* and the virtual plane VRN4 including the inner surface 4*d* of the fourth-stage dynode 4 is a distance corresponding to 1/7 to 1/5 a maximum distance (L3+D1) between the input opening edge 3*i* of third-stage box-and-grid dynode 3 and the secondary electron emitting layer 3*d* of the third-stage box-and-grid dynode 3.

To efficiently collect the electrons, this distance D1 is preferably 1/6 the maximum distance with respect to the third secondary electron emitting surface 3*d*.

A radius L6 of curvature of the curved potion 42 of the fourth dynode 4 is 4.50 mm. The radius L6 is in a range from 3.0 mm to 6.0 mm.

The radius L6 is defined by a length between a center P4 of the curvature of the curved portion 42 and the inner surface of the curved portion 42.

A length L5 between a fourth virtual input plane VRI4 and the center point P4 is 2.00 mm. The fourth virtual input plane VRI4 includes the fourth input opening edge 4*i*. The length L5 is in a range from 1.0 mm to 2.0 mm. The length L5 is a length of the first linear portion 41 along its surface, as shown in FIG. 4.

A distance L7 between a fourth virtual output plane VRO4 and the center point P4 is 2.35 mm. The fourth virtual output plane VRO4 includes the fourth output opening edge 4*o*. The length L7 is in a range from 2.0 mm to 2.5 mm. The length L7 is a length of the second linear portion 43 along its surface, as shown in FIG. 4. The length L7 is longer than the length L5.

An angle C4 between the fourth input opening edge 4*i* and the fourth output opening edge 4*o* is 60°. The fourth input opening edge 4*i* crosses the fourth output opening edge at an acute angle. An angle X4 at the circumference of the curved portion 42 is greater than 50° and smaller than 80°.

A distance L2 between the center point P4 and the first virtual plane VR1 is 21.9 mm.

A distance L8 between the fourth virtual input plane VRI4 and the third virtual output plane VRO3 is 1.00 mm. The length L8 is in a range from 0.5 mm to 1.5 mm.

A thickness of the fourth dynode L4 is 0.25 mm. A distance L9 between the center line CL1 of the tube VE and the fourth virtual input plane VRI4 is 8.50 mm. The center line CL1 penetrates a center of the first input aperture defined by the first input opening edge 1*i*.

The fourth-stage dynode 4 is arranged such that the electrons emitted from the third secondary electron emitting surface 3*d* pass through the fourth electron incident opening 4*i* and are irradiated on the fourth secondary electron emitting surface 4*d*, multiplied, and emitted from the fourth electron exit opening 4*o*.

With the above arrangement, the electrons are efficiently collected by the anode electrode 8.

The second dynode array is constituted by the fifth dynode 5, the sixth dynode 6, and the seventh dynode 7. These dynodes 5, 6 and 7 are in-line dynodes(second dynode array). The fourth dynode 4 is arranged between the first dynode 1 and the fifth dynode 5.

The second dynode array 5 to 7 is made up from a plurality of stages of dynodes 5 to 7 which extend in a direction from the third secondary electron emitting surface 3*d* to the third electron exit opening 3*o*.

The fifth-stage in-line dynode 5 has a fifth metal plate 5*m*, and a fifth secondary emitter 5*d* formed on an inner surface of the curved metal plate 5*m*.

The fifth secondary emitter 5*d* is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The fifth in-line dynode 5 has a fifth input opening edge 5*i*, and a fifth output opening edge 5*o*. An angle C5 between the fifth input opening edge 5*i* and the fifth output opening edge 5*o* is 145°. The angle C5 is in a range from 120° to 160°. The input opening edge 5*i* is substantially parallel to the fourth virtual inner plane VRN4.

The fifth dynode 5 is arranged such that the electrons emitted from the fourth secondary electron emitting surface 4*d* are irradiated on the fifth secondary electron emitting surface 5*d* through the fifth input aperture 5*i*, multiplied, and output through the fifth output aperture 5*o*.

The sixth-stage in-line dynode 6 has a sixth metal plate 6*m*, and a sixth secondary emitter 6*d* formed on an inner surface of the curved metal plate 6*m*.

The sixth secondary emitter 6*d* is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The sixth in-line dynode 6 has a sixth input opening edge 6*i*, and a sixth output opening edge 6*o*. An angle C6 between the sixth input opening edge 6*i* and the sixth output opening edge 6*o* is 145°. The angle C6 is in a range from 120° to 160°. The sixth input opening edge 6*i* is substantially parallel to the fifth input opening edge 5*i*.

The sixth dynode 6 is arranged such that the electrons emitted from the fifth secondary electron emitting surface 5*d* are irradiated on the sixth secondary electron emitting surface 6*d* through the sixth input aperture 6*i*, multiplied, and output through the sixth output aperture 6*o*.

The seventh dynode 7 has a seventh metal plate 7*m*, and a seventh secondary emitter 7*d* formed on an inner surface of the curved metal plate 7*m*.

The seventh secondary emitter 7*d* is made of secondary-emission material such as alkali antimony (for example $Cs_3Sb$), beryllium oxide (BeO:Cs), magnesium oxide (MgO:Cs), gallium phosphide, gallium arsenide phosphide, or Ag-O-Cs.

The seventh in-line dynode 7 has a seventh input opening edge 7*i*, and a seventh output opening edge 7*o*. An angle C7 between the seventh input opening edge 7*i* and the seventh output opening edge 7*o* is 145°. The angle C7 is in a range from 120° to 160°. The seventh input opening edge 7*i* is substantially parallel to the sixth input opening edge 5*i*.

The seventh dynode 7 is arranged such that the electrons emitted from the sixth secondary electron emitting surface 6*d* are irradiated on the seventh secondary electron emitting surface 7*d* through the seventh input aperture 7*i*, multiplied, and output through the seventh output aperture 7*o*.

The anode 8 is arranged between the seventh dynode 7 and the ultimate dynode 9, for collecting the multiplexed electrons.

The ultimate dynode 9 has a ninth metal plate 9*m*, and a ninth secondary emitter 9*d* formed on the metal plate 9*m*. The ninth secondary emitter 9*d* is made of secondary-emission material such as alkali antimony (for example $Cs_3Sb$), beryllium oxide(BeO:Cs), magnesium oxide (MgO:Cs), gallium phosphide, gallium arsenide phosphide, or Ag-O-Cs. The ninth secondary emitter layer 9*d* is arranged between the anode 8 and the metal plate 9*m*.

Next, the photomultiplier will be explained in more detail.

When predetermined potentials are applied to the aluminum coating AL, the dynodes 1 to 7 and 9, and anode 8 through the pins penetrating the vessel (evacuated envelope) VE, and light LIT1 is input into this photomultiplier through the faceplate VE1 and the photocathode PC, the light LIT1 is converted into electrons ELC1 and ELC2 by the photocathode PC.

In other words, when light LTI1 is incident on the photoelectric surface PC, electrons ELC1 and ELC2 are emitted from the photoelectric surface PC and introduced into the first-stage dynode 1 through the first input aperture defined by the first input opening edge 1*i*.

The electrons emitted from the photoelectric surface PC are multiplied by the first-stage dynode 1 and the second-stage dynode 2, and incident in the third-stage dynode 4*c*. Arrows 20, 21, and 22 indicate electron orbits(see FIG. 3).

Extensive experiments were required to manufacture the photomultiplier having the dynodes with the above shapes and arrangement. More specifically, in the manufacture of the photomultiplier having the dynodes with the above shapes and arrangement, the present inventors manufactured a photomultiplier sample having box-and-grid dynodes and in-line dynodes with shapes as shown in FIG. 5.

Figure 5:
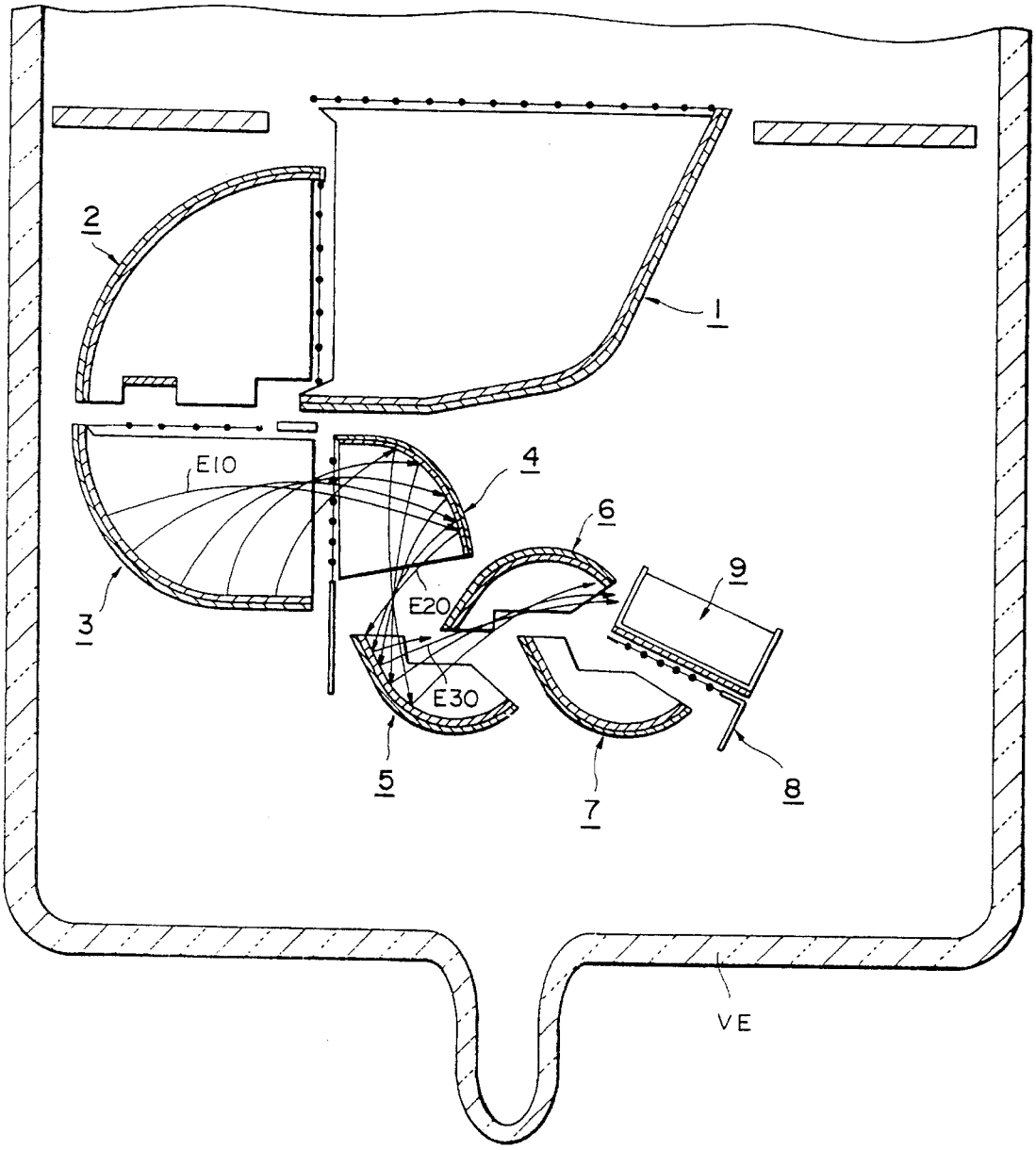
FIG. 5 is a sectional view of the dynodes of the photomultiplier according to the present invention.

FIG. 5 is a sectional view showing the dynodes of this photomultiplier. Arrows E10, E20 and E30 indicate electron orbits. Electrons emitted from the third-stage box-and-grid dynode 3 move toward the center of curvature of the fourth-stage connecting dynode 4 because the inner wall of the fourth-stage connecting dynode 4 is largely curved as shown in FIG. 5. For this reason, the electrons are incident on the upper end portion of the fifth-stage in-line dynode 5. However, most of the electrons emitted from the upper end portion of the fifth-stage in-line dynode 5 are not incident on the sixth-stage in-line dynode 6. More specifically, the electrons moving on the electron orbit E30 pass between the sixth-stage in-line dynode 6 and the ultimate dynode 9.

Figure 6:
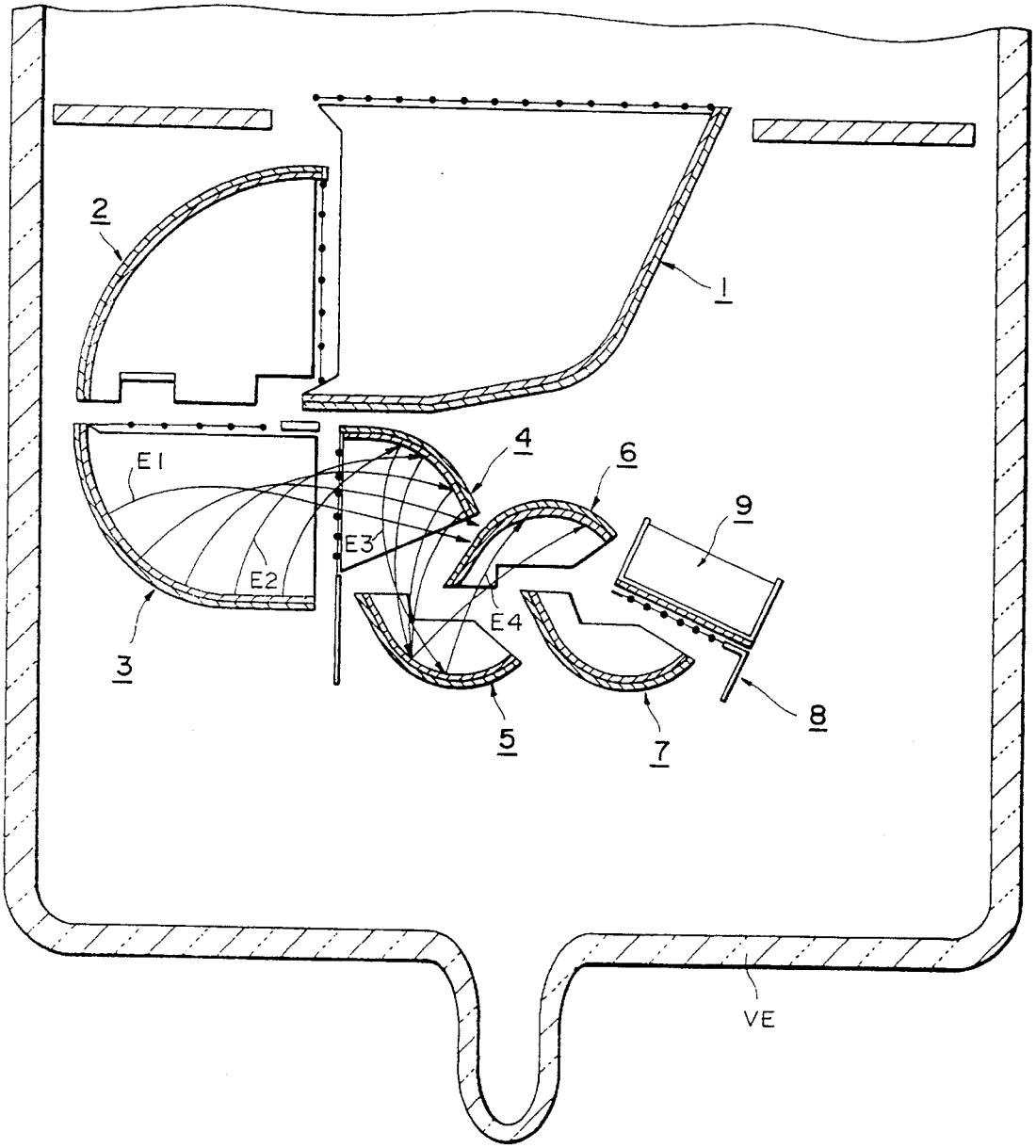
FIG. 6 is a sectional view of the dynodes of the photomultiplier according to the present invention.

As shown in FIG. 6, an inner surface of the fourth-stage connecting dynode 4 was formed to have a shape as shown in FIGS. 3 and 4, i.e., a composite shape of part of the circumferential surface and a plane extending from the circumferential surface toward the third electron exit opening. With this shape, the potential of the sixth-stage in-line dynode 6 acted inside the fourth-stage connecting dynode 4. The electrons emitted from the fourth-stage connecting dynode 4 were attracted by the sixth-stage in-line dynode 4*f* through the electron orbit E3 and incident on a portion where the fifth-stage in-line dynode 6 efficiently worked. In this manner, the electrons indicated by an electron orbit E4 are incident in the sixth-stage in-line dynode 6. However, some of the electrons from the third-stage box dynode 3, which are indicated by an electron orbit E1, are incident on the rear surface of the sixth-stage in-line dynode 6 without passing through the fourth-stage connecting dynode 4.

When the fourth-stage connecting dynode 4 was arranged as shown in FIGS. 3 and 4 while the shapes shown in FIG. 6 were maintained, i.e., when the position of the connecting dynode 4 was shifted downward by 1.5 mm, the electrons were efficiently incident in the fourth-stage connecting dynode 4, and the efficiency of electron irradiation from the fourth-stage connecting dynode 4 to the fifth-stage in-line dynode 5 increased to 66%. In the photomultiplier shown in FIGS. 3 and 4, the gain was improved to 20 or more times that of the conventional photomultiplier described in Japanese Patent Laid-Open No. 59-108254, and the rise time was shortened to 4.8 scale.

With the above arrangement, as for the problem of after pulse, ions returning from the last-stage dynode 9 were limited and decreased to ½ those in a photomultiplier described in the conventional photomultiplier.

As has been described above, in the photomultiplier according to the present invention, the gain is improved to 20 or more times that of the conventional photomultiplier described in Japanese Patent Laid-Open No. 59-108254, and the rise time is shortened to 4.8 nsec(nsec=$10^{-9}$ sec). For this reason, the tube length can be shortened while the high-speed/high-gain characteristics are maintained. Therefore, the number of dynodes, which must be ten in the conventional photomultiplier, can be decreased to eight, thereby obtaining a compact photomultiplier.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A photomultiplier, comprising:

a vessel;

a photocathode arranged in said vessel;

a first dynode array including box-and-grid dynodes, being arranged in said vessel;

a second dynode array including in-line dynodes, being arranged in said vessel; and a dynode having a curved secondary electron emitting layer opposing both a secondary electron emitting layer of a last-stage dynode of said first dynode array and a secondary electron emitting layer of a first-stage dynode of said second dynode array.

2. A photomultiplier, comprising:

a vessel;

a photocathode arranged in said vessel;

a first-stage dynode opposing said photocathode, having an inner surface including a secondary electron emitting layer and an outer surface;

a second-stage dynode opposing said first-stage dynode;

a third-stage box-and-grid dynode arranged in said vessel, having an inner surface including a secondary electron emitting layer, an input opening edge opposing said second-stage dynode, and an output opening edge crossing said input opening edge;

a fourth-stage dynode having an inner surface including a secondary electron emitting layer, a minimum distance between said inner surface of said fourth-stage dynode and said outer surface of said first-stage dynode being greater than a minimum distance between said input opening edge of said third-stage dynode and said outer surface of said first-stage dynode; and fifth-stage in-line dynode opposing said fourth-stage dynode.

3. A photomultiplier according to claim 2, wherein said secondary electron emitting layer of said fourth-stage dynode comprises:

a curved potion;

a first linear potion extending from said curved portion toward said third-stage dynode; and a second linear potion extending from said curved portion toward said fifth-stage in-line dynode.

4. A photomultiplier according to claim 3, wherein said fourth-stage dynode comprises a grid disposed between said inner surface of said fourth-stage dynode and said third-stage dynode, and wherein an angle at a circumference of said curved portion is greater than 50° and smaller than 80°.

5. A photomultiplier according to claim 2, wherein a minimum distance between the third input opening edge and a virtual plane including said inner surface of said fourth-stage dynode is a distance corresponding to 1/7 to 1/5 a maximum distance between said input opening edge of said third-stage box-and-grid dynode and said secondary electron emitting layer of said third-stage box-and-grid dynode.

6. A photomultiplier according to claim 2, wherein said fourth-stage dynode has a grid including a mesh portion, and a shielding-plate portion extending from said grid.

* * * * *